US007137482B2

(12) United States Patent
Underhill et al.

(10) Patent No.: US 7,137,482 B2
(45) Date of Patent: Nov. 21, 2006

(54) LADDER STAND-OFF

(76) Inventors: Philip Orlando Underhill, 72 Sherwood Forest, Exeter, NH (US) 03833; Pamela A. Heafey, 108 Locksley Rd., Lynnfield, MA (US) 01940; Michael S. Heafey, 107 Atlantic St., Quincy, MA (US) 02171

( * ) Notice: Subject to any disclaimer, the term of this patent is extended or adjusted under 35 U.S.C. 154(b) by 53 days.

(21) Appl. No.: 10/946,136

(22) Filed: Sep. 21, 2004

(65) Prior Publication Data

US 2005/0072633 A1 Apr. 7, 2005

Related U.S. Application Data

(63) Continuation-in-part of application No. 10/680,648, filed on Oct. 7, 2003, now Pat. No. 6,962,237.

(51) Int. Cl.
*E06C 7/06* (2006.01)
*E06C 7/42* (2006.01)
*E06C 7/14* (2006.01)

(52) U.S. Cl. ..... 182/214; 182/107; 248/210

(58) Field of Classification Search ..... 182/214, 182/107, 121, 230, 108; 248/238, 210, 211, 248/235; D25/68

See application file for complete search history.

(56) References Cited

U.S. PATENT DOCUMENTS

| | | | | |
|---|---|---|---|---|
| 1,004,284 | A * | 9/1911 | Lehmann | 182/214 |
| 3,146,854 | A * | 9/1964 | Terwilliger | 182/214 |
| 3,459,277 | A * | 8/1969 | Frederick | 182/214 |
| 5,242,031 | A * | 9/1993 | Ashley | 182/214 |
| 6,244,382 | B1 * | 6/2001 | Labonte | 182/107 |
| 6,250,424 | B1 * | 6/2001 | Laug | 182/107 |
| 6,360,845 | B1 * | 3/2002 | Allison | 182/107 |
| 6,691,825 | B1 * | 2/2004 | Haig | 182/107 |
| 6,698,547 | B1 * | 3/2004 | Uridel | 182/107 |
| 6,962,237 | B1 * | 11/2005 | Underhill | 182/107 |
| 6,997,283 | B1 * | 2/2006 | Wollenberg et al. | 182/214 |

FOREIGN PATENT DOCUMENTS

| | | | | |
|---|---|---|---|---|
| EP | 355504 | A1 * | 2/1990 | 182/214 |

* cited by examiner

*Primary Examiner*—Hugh B. Thompson, II
(74) *Attorney, Agent, or Firm*—Preti Flaherty

(57) ABSTRACT

A ladder stand-off includes an extension beam and first and second stand-off sections slidingly mounted on the extension beam, so as to provide an adjustable span. Each stand-off section includes a support beam and an arm fixedly connected to the first support beam. A contact element is pivotally contacted to the outer end of each arm, allowing the device to be used with flat, curved and corner surfaces. The two arms preferably extend in an outward direction so as to be angularly divergent with respect to each other. The device can also be implemented as a ladder stand-off kit having multiple extension beams of different lengths that can be used interchangeably with the two ladder stand-off sections. In this case, the desired extension beam would be assembled with the first and second stand-off sections to form a ladder stand-off.

32 Claims, 13 Drawing Sheets

LADDER STAND-OFF

CROSS REFERENCES TO RELATED APPLICATIONS

This application is a Continuation-In-Part of copending U.S. patent application Ser. No. 10/680,648, entitled "LADDER STAND-OFF" and filed Oct. 7, 2003, now U.S. Pat. No. 6,962,237.

BACKGROUND OF THE INVENTION

This invention relates generally to ladder stand-offs and more particularly to ladder stand-offs useful in corner applications.

Ladders are commonly used for many tasks to enable the user to reach locations that otherwise could not be reached. One of the most common types of ladders is the lean-on ladder which comprises a pair of laterally spaced side rails interconnected by a plurality of longitudinally spaced rungs. In use, the bottom of the ladder is supported on the ground or a floor and the top of the ladder is placed against a wall or similar vertical surface. Generally, lean-on ladders should be oriented at an angle of lean (i.e., the angle between the ladder and the ground or floor) of approximately 70–80 degrees for safe and stable deployment.

It is known to use ladder attachments such as stand-offs with lean-on ladders to increase ladder stability. Such devices are attached to the upper portion of the ladder and position the ladder away from the wall that it is leaned against. Stand-offs designed to be used in corner applications have also been proposed. However, many known stand-offs are not readily used with both flat and corner surfaces or require manual adjustment of various moving parts to permit use with different surfaces. Such moving parts are susceptible to becoming lost or broken. Many current stand-offs are also big and bulky and thus not suitable for use in tight spaces.

Accordingly, there is a need for a ladder stand-off that is compact and easy to use and can be used on both flat and corner surfaces without excessive adjustable parts.

SUMMARY OF THE INVENTION

The above-mentioned need is met by the present invention, which provides a ladder stand-off having an extension beam and first and second stand-off sections slidingly mounted on the extension beam, so as to provide an adjustable span. The first stand-off section includes a first support beam and a first arm fixedly connected to the first support beam, and the second stand-off section includes a second support beam and a second arm fixedly connected to the second support beam. A contact element is pivotally contacted to the outer end of each arm. In one embodiment, each arm is connected to the respective support beam at a point located between the two ends of the support beam, and the two arms extend in an outward direction so as to be angularly divergent with respect to each other. The ladder stand-off also includes means for being detachably secured to a ladder.

In one possible embodiment, each of the support beams defines a hollow interior such that a portion of the extension beam can be slidingly received in the support beam. Means for fixing each stand-off section relative to the extension beam are included.

The present invention can also be implemented as a ladder stand-off kit having multiple extension beams of different lengths that can be used interchangeably with the two ladder stand-off sections. In this case, the desired extension beam would be assembled with the first and second stand-off sections to form a ladder stand-off.

The present invention and its advantages over the prior art will be more readily understood upon reading the following detailed description and the appended claims with reference to the accompanying drawings.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
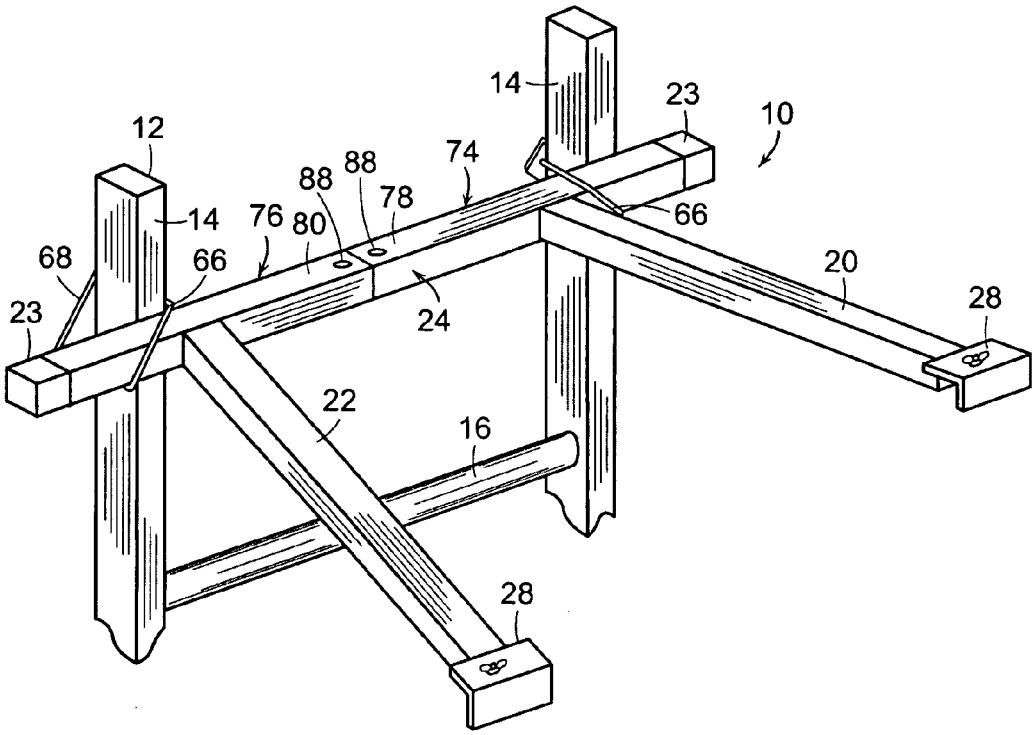
FIG. 1 is a perspective view of a ladder stand-off detachably secured to a ladder.

Referring to the drawings wherein identical reference numerals denote the same elements throughout the various views, FIG. 1 shows a ladder stand-off 10 detachably secured to a conventional ladder 12. The ladder 12 illustrated in the Figures is a common lean-on ladder having a pair of laterally spaced side rails 14 interconnected by a plurality of longitudinally spaced rungs 16. The ladder stand-off 10 can be used with extendible and non-extendible ladders. It is also possible to use the ladder stand-off 10 with folding step ladders when folded closed and used in the manner of a lean-on ladder (i.e., leaned against a wall or other vertical surface).

Referring to FIGS. 1–8, the ladder stand-off 10 includes an extension beam 18 and first and second stand-off sections 74 and 76 slidingly mounted on the extension beam 18. The extension beam 18 should be suitably strong and rigid and is preferably a straight piece having a predetermined length. In one embodiment, the extension beam 18 can comprise square aluminum tubing, which is suitably strong and rigid while being relatively lightweight. The first stand-off section 74 includes a first support beam 78 and a first arm 20 fixedly connected to the first support beam 78. The second stand-off section 76 includes a second support beam 80 and a second arm 22 fixedly connected to the second support beam 80. The first and second support beams 78 and 80 should also be suitably strong and rigid; as with the extension beam 18, square aluminum tubing is one suitable material. The two arms 20 and 22 generally have similar material characteristics and are preferably, although not necessarily, made of the same material as the support beams 78 and 80. An end cap 23 made of a relatively soft, pliant material can be provided on the outer end of each support beam 78 and 80.

In one embodiment, the first and second support beams 78 and 80 are slidingly mounted on the extension beam 18 in a telescoping manner. To accomplish this, the support beams 78 and 80 are open at the ends so as to define hollow interiors that are shaped to match the exterior shape of the extension beam 18. The cross-sectional dimensions of the support beams 78 and 80 are slightly greater than that of the extension beam 18. This permits a first portion of the extension beam 18 (e.g., all or part of one half of the extension beam) to be slidingly received in the hollow interior of the first support beam 78 and a second portion of the extension beam 18 (e.g., all or part of the other half of the extension beam) to be slidingly received in the hollow interior of the second support beam 80. Accordingly, the first portion of the extension beam 18 fits into the first support beam 78, and the second portion of the extension beam 18 fits into the second support beam 80, thereby slidingly mounting the first and second stand-off sections 74 and 76 on the extension beam 18.

Figure 4:
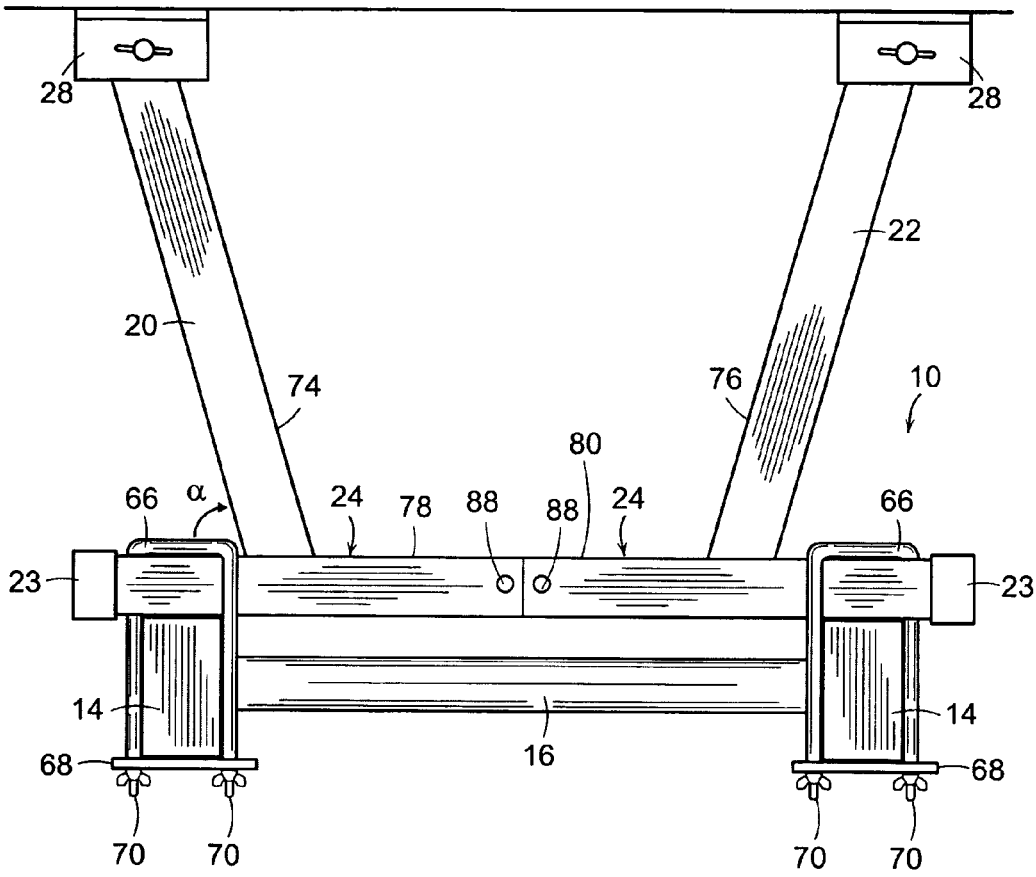
FIG. 4 is a top view of the ladder stand-off, in the compact mode, in use with a flat wall.
Figure 5:
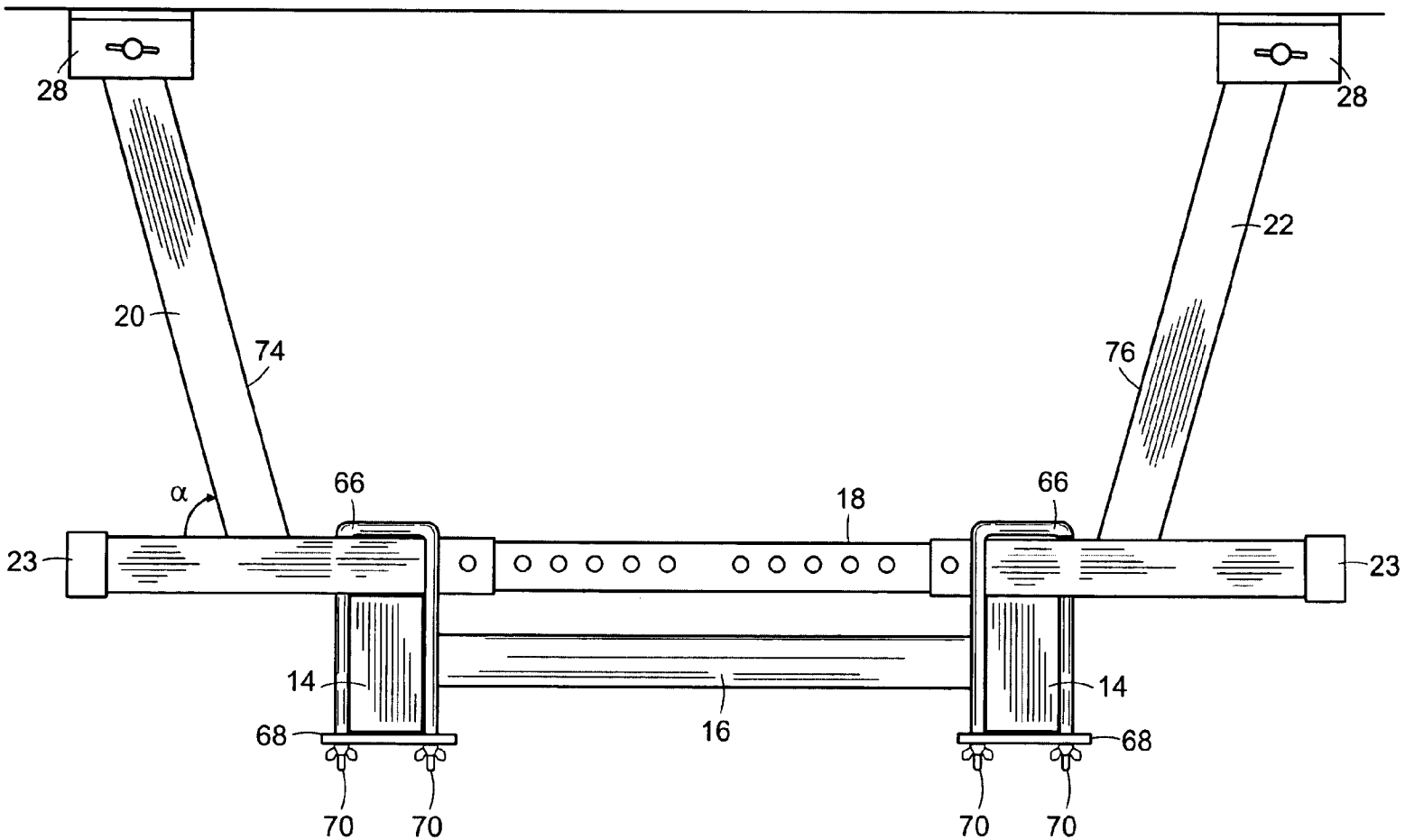
FIG. 5 is a top view of the ladder stand-off, in an expanded mode, in use with a flat wall.
Figure 6:
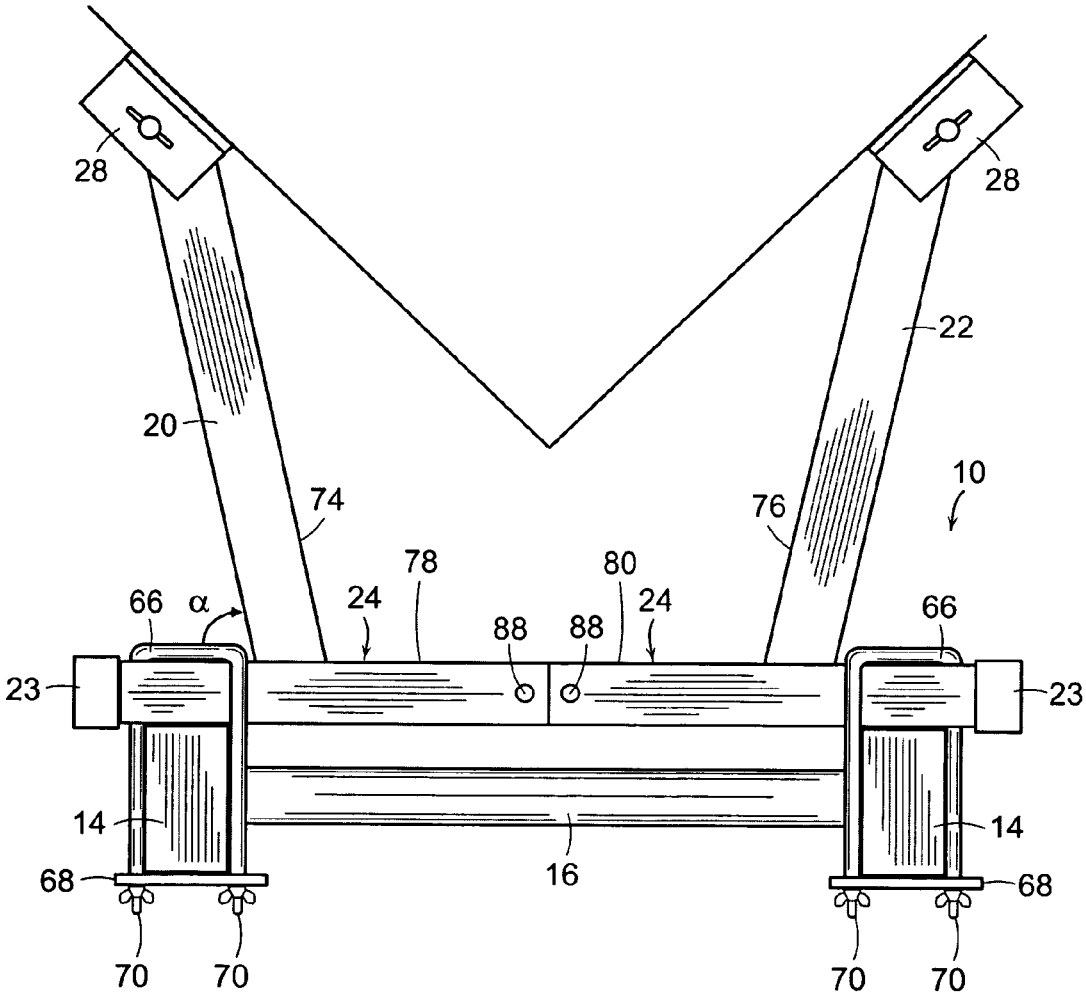
FIG. 6 is a top view of the ladder stand-off in use with an outside corner.
Figure 7:
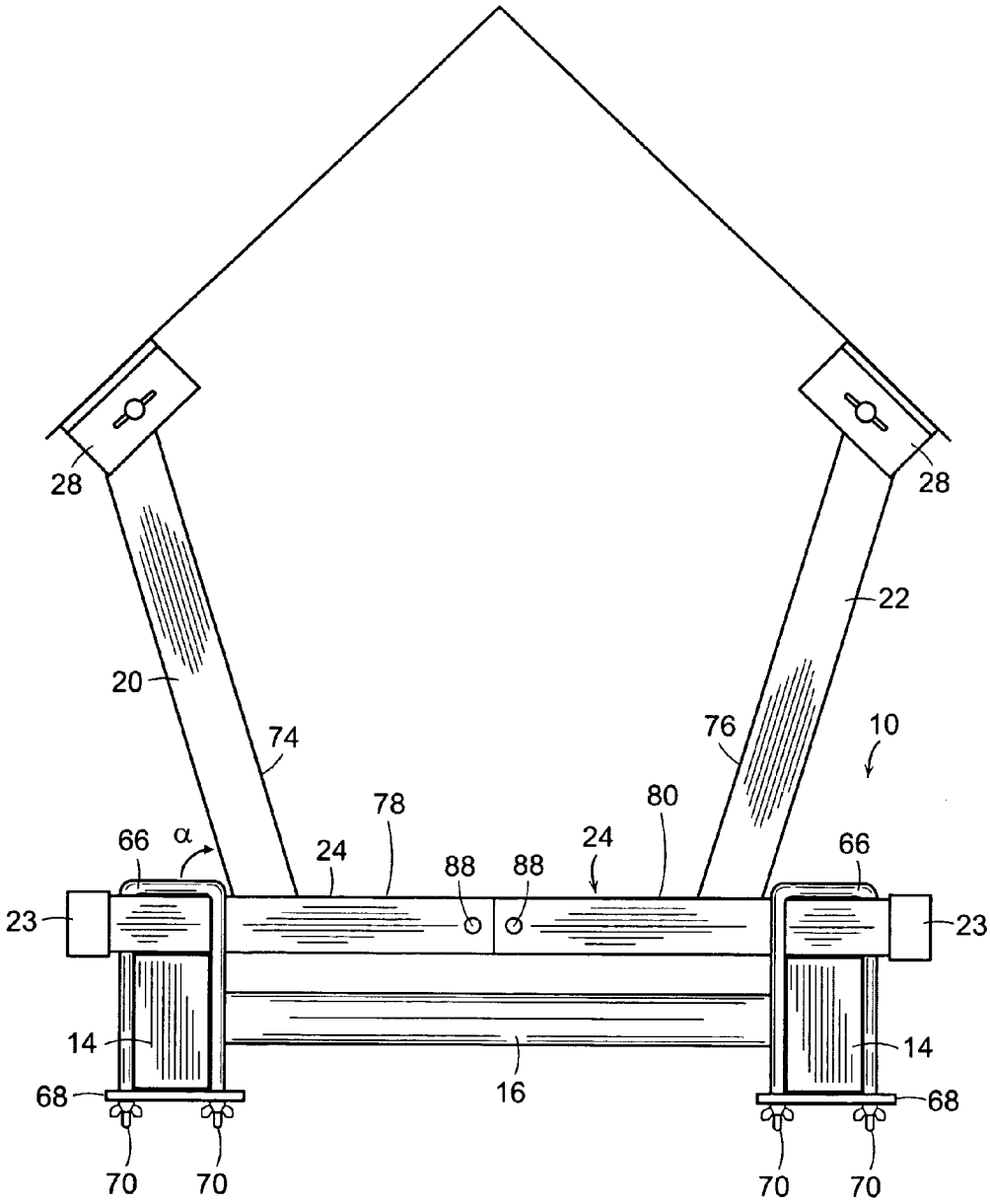
FIG. 7 is a top view of the ladder stand-off in use with an inside corner.

With this arrangement, the positions of the first and second stand-off sections 74 and 76 on the extension beam 18 can be adjusted. For instance, FIG. 4 shows the two stand-off sections 74 and 76 both fully positioned on the extension beam 18 so that their inner ends are abutting, thereby defining the most closed or compact mode of the ladder stand-off 10. FIG. 5 shows the ladder stand-off 10 in an expanded mode, that is, with the two stand-off sections 74 and 76 positioned farther out on the extension beam 18 so that the distance between the distal ends of the arms 20 and 22 (referred to herein as the span of the ladder stand-off 10) is greater than that it of the compact mode.

The ladder stand-off 10 further includes means for fixing the first and second stand-off sections 74 and 76 relative to the extension beam 18. One possible embodiment of a means for fixing the stand-off sections 74 and 76 includes a hole 82 formed through the first support beam 78, a hole 84 formed through the second support beam 80, and a plurality of holes 86 formed through, a spaced longitudinally along, the extension beam 18. The first stand-off section 74 is fixed relative to the extension beam 18 by aligning the hole 82 with a selected one of the holes 86, inserting a bolt 88 (such as a carriage bolt) through the aligned holes 82, 86, and securing the bolt 88 with a wing nut 90. Similarly, the second stand-off section 76 is fixed relative to the extension beam 18 by aligning the hole 84 with another selected one of the holes 86, inserting a bolt 88 through the aligned holes 84, 86, and securing the bolt 88 with a wing nut 90. In both instances, the bolts 88 are arranged with the bolt heads on the upper surfaces of the support beams 78 and 80 and the wing nuts 90 underneath so that the wing nuts 90 are less likely to interfere with the user. Pins retained by a spring clip or cotter pin could be used as an alternative to threaded bolts. Because of the plurality of holes 86 in the extension beam 18, the stand-off sections 74 and 76 can be selectively positioned in a number of locations on the extension beam 18. This allows the ladder stand-off 10 to be set up with spans of various widths, depending on the needed application. For example, when working in tight spaces, the ladder stand-off 10 can be set up in the compact mode shown in FIG. 4. When needing to span a wide object such as a window, the ladder stand-off 10 can be set up in an expanded mode, such as that shown in FIG. 5.

Each of the first and second arms 20 and 22 is joined, at a first end thereof, to a first surface 24 of its corresponding support beam 78, 80. The first and second arms 20 and 22 are fixedly joined, such as by welding or the like, to the corresponding support beam 78, 80. The first arm 20 is joined to the first support beam 78 at a first point between the two ends of the first support beam 78, so as to be positioned approximately in the center of the first support beam 78. The second arm 22 is joined to the second support beam 80 at a first point between the two ends of the second support beam 80, so as to be positioned approximately in the center of the second support beam 80. The first and second connection points are spaced apart a predetermined distance (which distance is dependent on the positioning of the stand-off sections 74 and 76 relative to the extension beam 18). The first connection point is spaced a predetermined distance from the outer end of the first support beam 78, and the second connection point is spaced the same predetermined distance from the outer end of the second support beam 80. This distance is sufficient to permit the ladder stand-off 10 to be attached to a ladder, in a manner described below.

Figure 2:
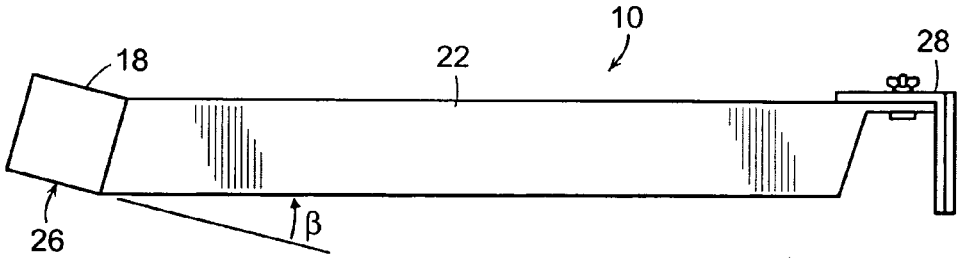
FIG. 2 is a side view of the ladder stand-off of FIG. 1, separate from the ladder.
Figure 3:
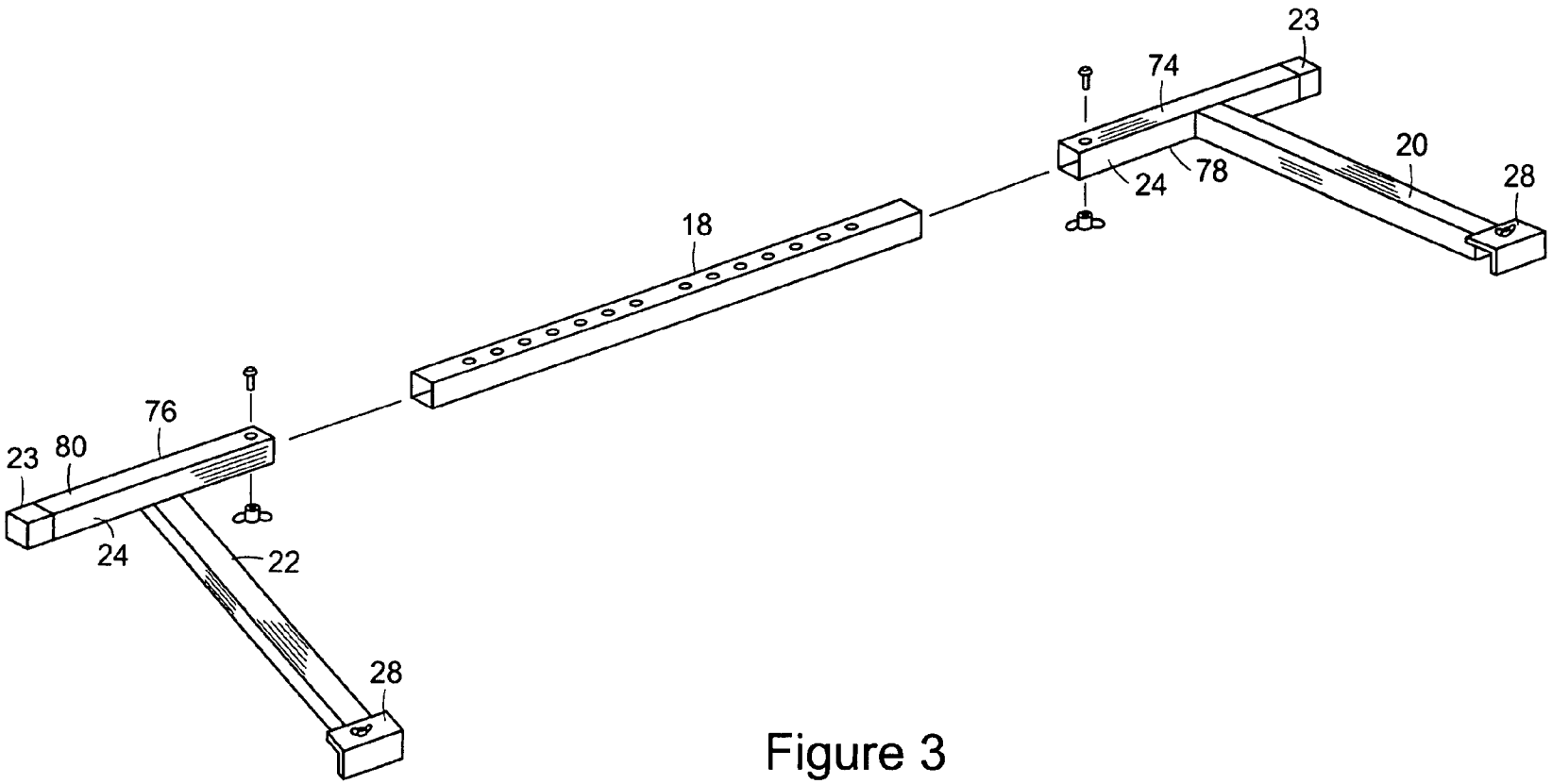
FIG. 3 is an exploded view of the ladder stand-off of FIG. 1.

The first and second arms 20 and 22 extend outwardly from the corresponding first beam surface 24 so as to be angularly divergent with respect to each other, generally defining an angle therebetween that is less than 90 degrees. Specifically, the first and second arms 20 and 22 each forms an outside angle $\alpha$ with the corresponding first beam surface 24 (which extends in a direction parallel to the longitudinal axis of the extension beam 18) that is less than 90 degrees. In this case, the distal ends of the first and second arms 20 and 22 are spaced apart a distance that is greater than the distance that the fixed ends of the first and second arms 20 and 22 are spaced apart. The angle $\alpha$ is generally in the range of 70–85 degrees. The first and second arms 20 and 22 are also angled relative to a second surface 26 of the corresponding support beam 78, 80, which is perpendicular to the first beam surface 24. As best seen in FIG. 2, the first and second arms 20 and 22 are both angled upward at an angle $\beta$ relative to the corresponding second beam surface 26. The angle $\beta$ will typically be in the range of 10–20 degrees, depending on the desired angle of lean that the ladder 12 is to make with respect to the ground or floor.

Figure 9:
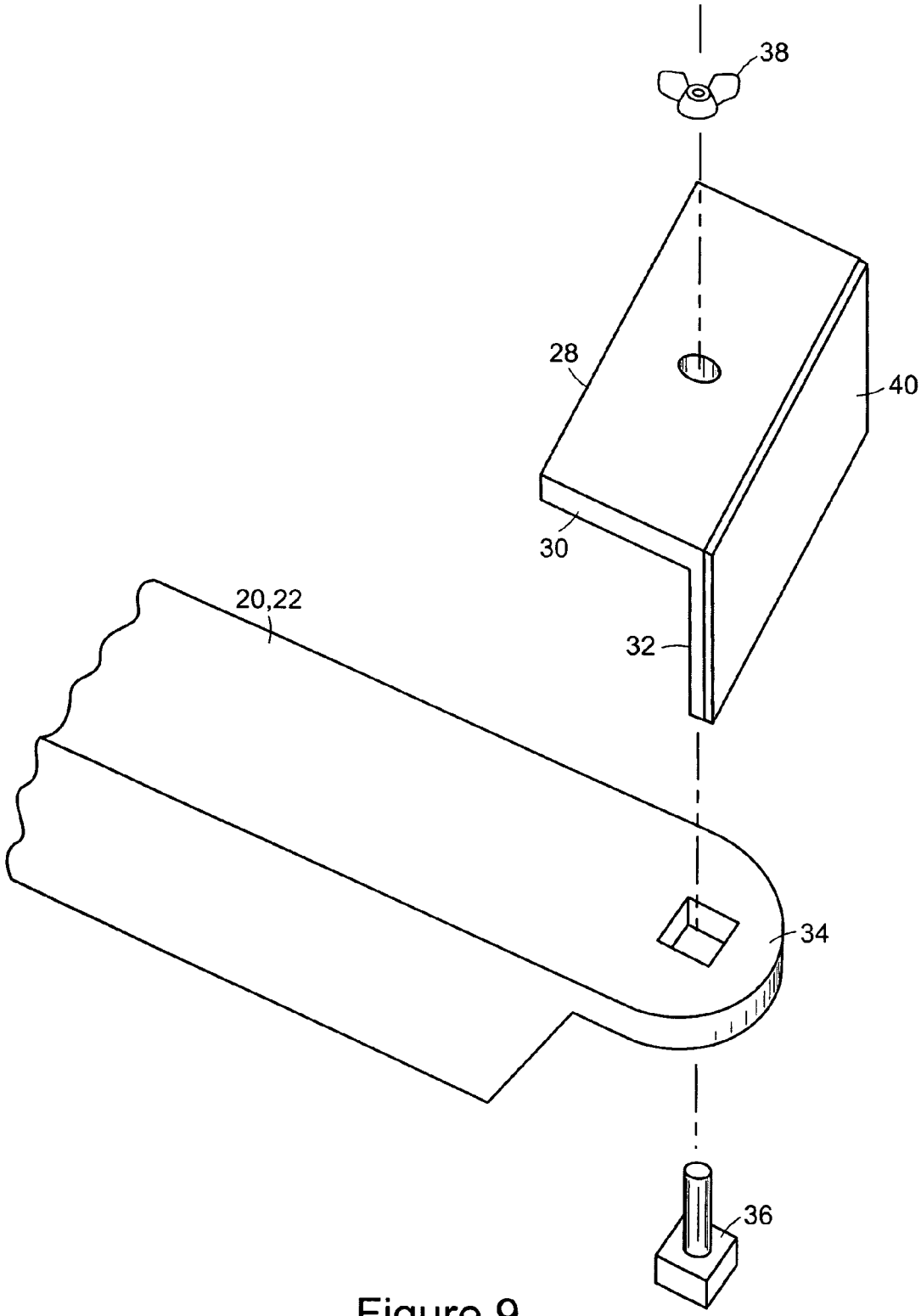
FIG. 9 is an exploded view of a first embodiment of a pivoting contact element used with the ladder stand-off.

The ladder stand-off 10 includes a contact element 28 pivotally connected to the distal end of each of the first and second arms 20 and 22. Referring to FIG. 9, each contact element 28 comprises an L-shaped member having perpendicular first and second sections 30 and 32. Each arm 20 and 22 has a flange 34 extending longitudinally outward from its distal end, coextensive with the upper surface of the arm. The contact elements 28 are positioned with the first section 30 overlying the flange 34 and the second section 32 extending downward therefrom. Pivot pins 36 are provided through aligned holes formed in the first sections 30 and the flanges 34 to pivotally mount the contact elements 28 to the corresponding arm 20, 22. In one possible embodiment, the pivot pins 36 are carriage bolts secured with wing nuts 38.

Other types of fastening means, such as a pin retained by a spring clip or cotter pin, can alternatively be used. The flanges 34 are rounded so that the contact elements 28 are able to pivot relative to the respective arm 20, 22 through a full range of motion of at least 180 degrees. Each contact element 28 has a resilient pad 40 mounted on the outside surface of its second section 32. The resilient pads 40, which contact and protect the surface the ladder 12 is leaned against when in use, can be corrugated with the corrugations extending vertically so that any water or moisture present will be free to drain away. The contact elements 28 and the pads 40 preferably have sufficient width, such as four inches or more, so as to ensure stable, slip-free contact with the support surface.

Figure 10A:
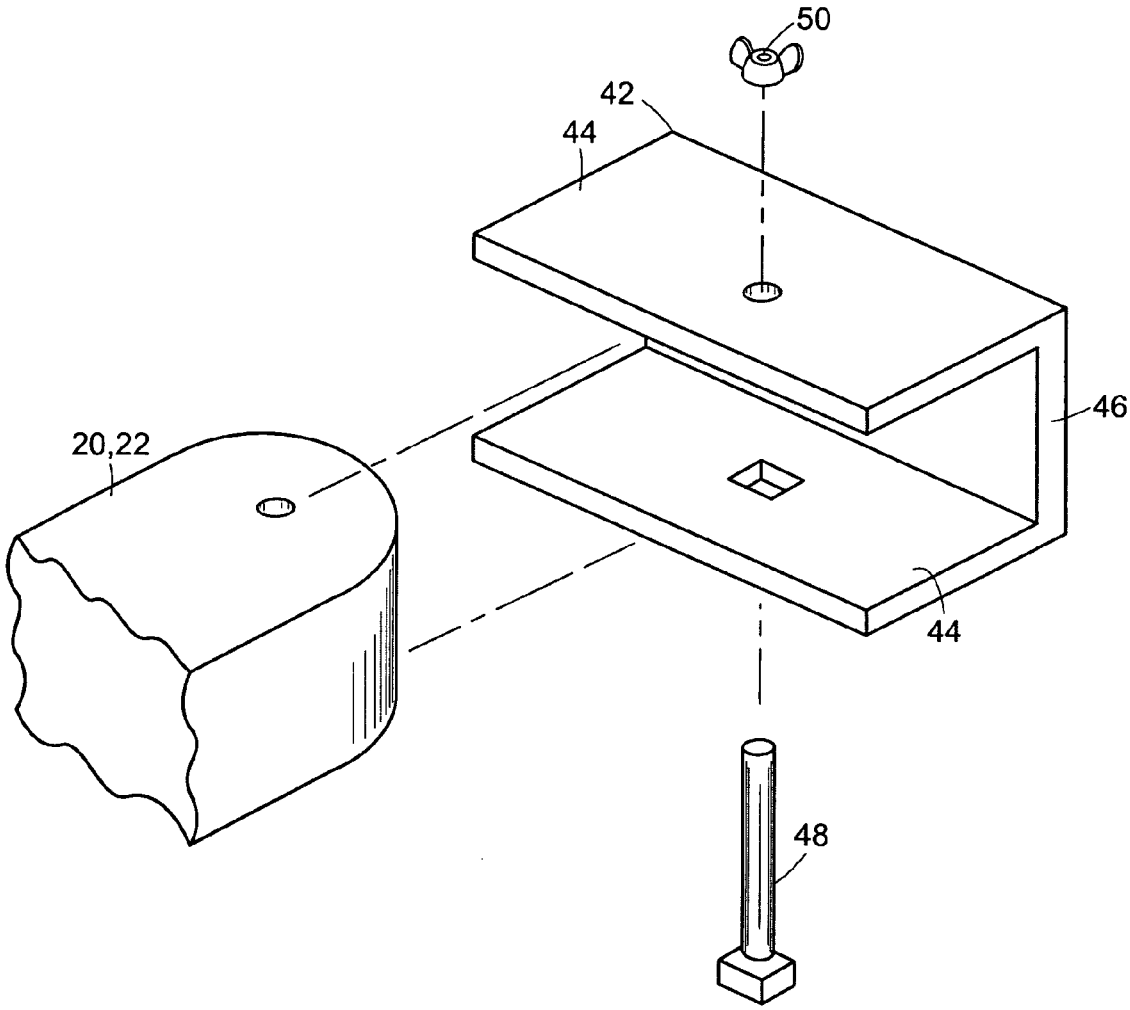
FIG. 10A is an exploded view of a second embodiment of a pivoting contact element used with the ladder stand-off.

Referring to FIG. 10A, an alternative contact element 42 is shown. In this embodiment, each contact element 42 comprises a U-shaped member having two parallel side legs 44 joined by a central web 46 defining an outer contact surface. The contact element 42 is positioned with the side legs 44 straddling the distal end of the corresponding arm 20, 22. A pivot pin 48, preferably but not necessarily a carriage bolt secured by a wing nut 50, is provided through aligned holes formed in the side legs 44 and the corresponding arm 20, 22 to pivotally mount the contact elements 42. Other types of fastening means, such as a pin retained by a spring clip or cotter pin, can alternatively be used. The distal ends of the arms 20 and 22 are rounded so that the contact elements 42 are able to pivot relative to the respective arm 20, 22 through a full range of motion of at least 180 degrees. The entire U-shaped contact element 42 can be made of a resilient material such as rubber with vertically extending corrugations formed on the outer contact surface of the central web 46.

Figure 10B:
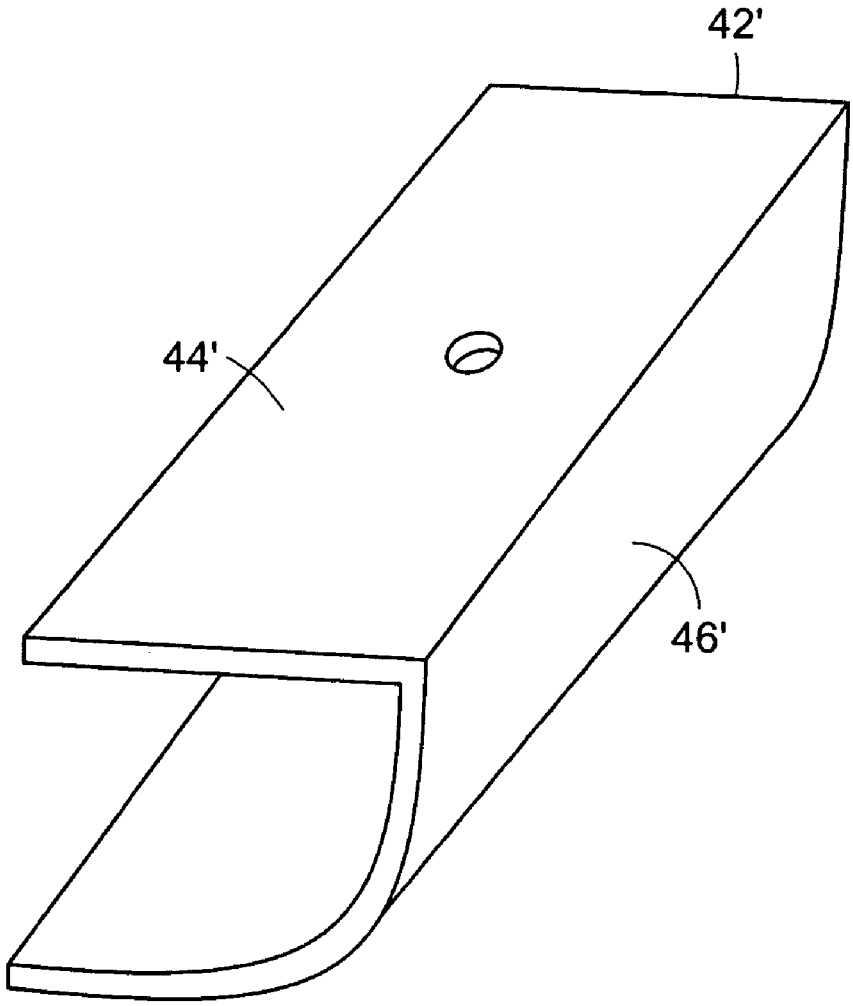
FIG. 10B is a perspective view of an alternative configuration of the second embodiment of the pivoting contact element.

FIG. 10B shows an alternative configuration for the U-shaped contact element. In this case, each contact element 42' comprises a planar section 44' and a curved section 46' defining an outer contact surface. The contact element 42' is positioned with the planar section 44' overlying the upper surface of the corresponding arm 20, 22 and the curved section 46' extending downward and under the arm. The curvature allows the contact element 42' to engage both vertical surfaces and slanted surfaces such as roofs. Pivot pins (not shown in FIG. 10B) are provided through aligned holes to pivotally mount the contact element 42' to the corresponding arm.

Figure 11:
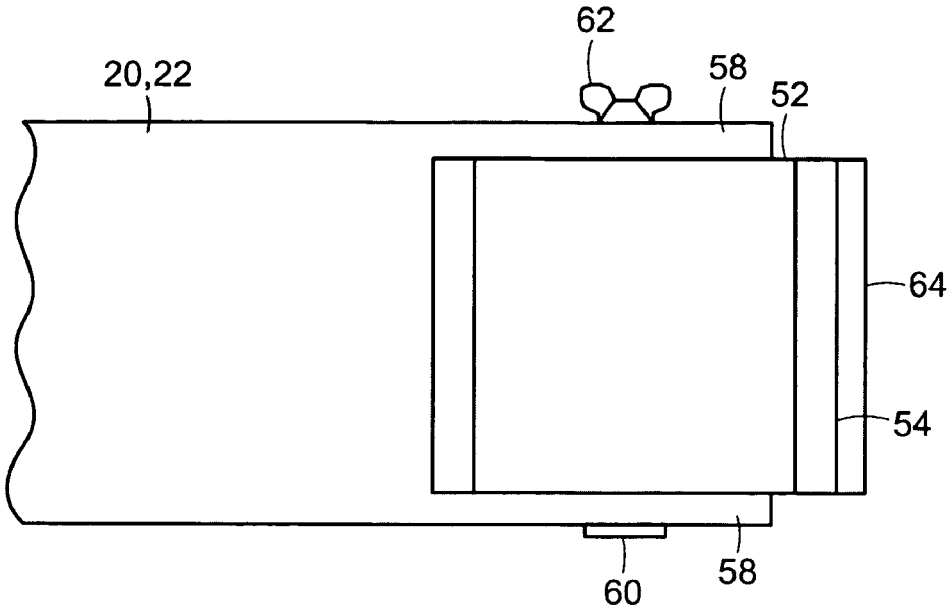
FIG. 11 is a side view of a third embodiment of a pivoting contact element used with the ladder stand-off.
Figure 12:
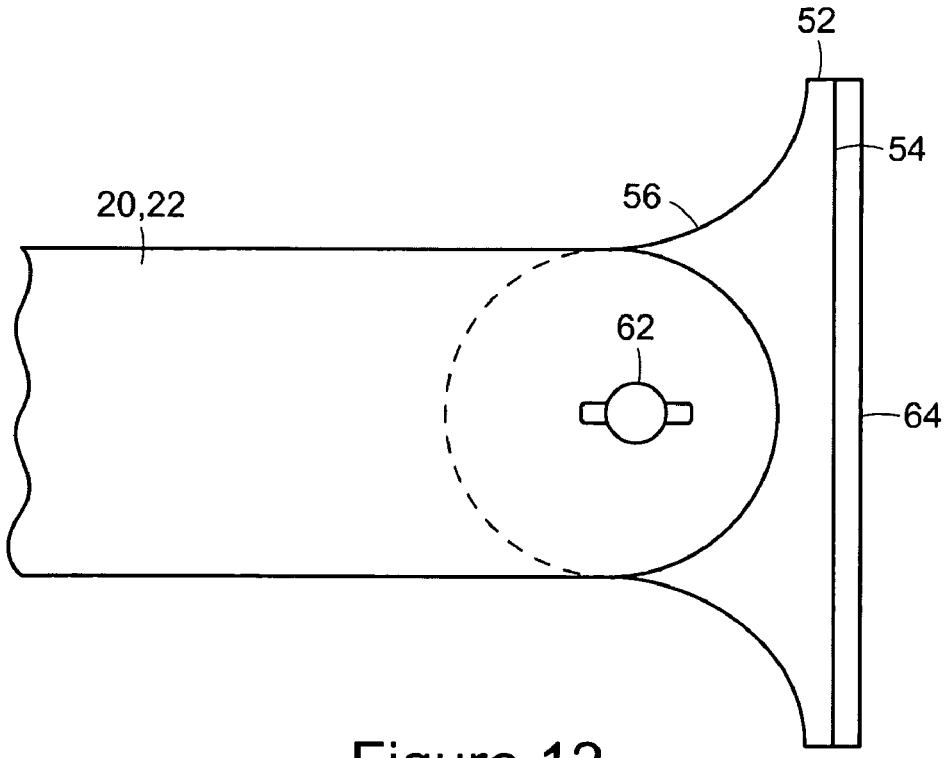
FIG. 12 is a top view of the third embodiment of a pivoting contact element used with the ladder stand-off.

Referring to FIGS. 11 and 12, yet another alternative contact element 52 is shown. In this embodiment, each contact element 52 has a flat contact surface 54 and a rounded surface 56. Each arm 20 and 22 has a pair of flanges 58 extending longitudinally outward from its distal end, coextensive with the lower and upper surfaces of the arm. The contact element 52 is positioned between the flanges 58 with the flat contact surface 54 facing outward. A pivot pin 60, preferably but not necessarily a carriage bolt secured by a wing nut 62, is provided through aligned holes formed in the flanges 58 and the contact element 52 to pivotally mount the contact elements 52 to the corresponding arm 20, 22. The rounded surface 56 permits the contact elements 52 to pivot relative to the respective arm 20, 22 through a full range of motion of at least 180 degrees. The contact element 52 can either be made of a resilient material or have a resilient pad 64 mounted on the flat contact surface 54.

The ladder stand-off 10 is generally sized based on the size of the ladder that it is to be used with. In the illustrated embodiment, for example, the combined length of the first and second support beams 78 and 80 (which are preferably, although not necessarily, equal in length) is just slightly longer than the width of the ladder 12. Furthermore, the length of the extension beam 18 is preferably substantially equal to the combined length of the first and second support beams 78 and 80. Moreover, the span of the ladder stand-off 10 (i.e., the distance between the distal ends of the first and second arms 20 and 22) in the compact mode is preferably equal to, or slightly greater than, the width of the ladder 12, while being less than the combined length of the first and second support beams 78 and 80. For example, for a ladder that is 19 inches wide (which is a typical ladder width), a combined support beam length of 21 inches would be desirable. The distance between the first and second connection points of the fixed ends of the first and second arms 20 and 22, with the ladder stand-off in its compact mode, is approximately 12 inches. The arms 20 and 22 in the illustrated embodiment are 13.5 inches long and define an angle $\alpha$ of 75 degrees, which results in a compact mode span of about 19 inches. Many other sizes and dimensions are possible. For instance the extension beam length could be significantly greater than the combined length of the first and second support beams 78 and 80.

Figure 13:
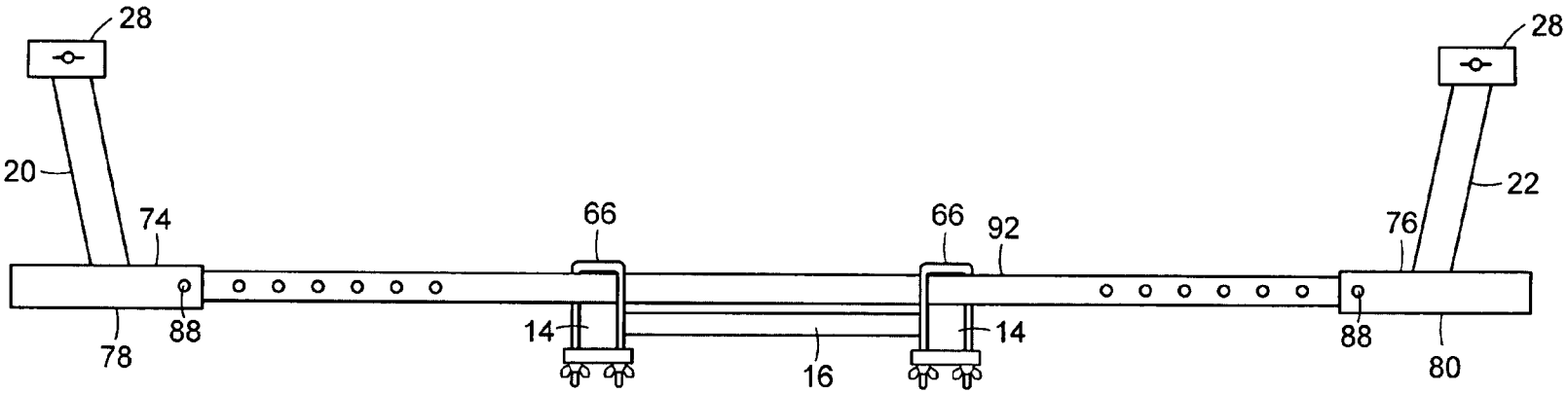
FIG. 13 is a top view of a ladder stand-off employing a longer extension beam.

The ladder stand-off 10 can alternatively be provided with multiple extension beams of different lengths to provide even more variability in the span of the device. For instance, in addition to the extension beam 18, the ladder stand-off 10 could be provided with a second, longer extension beam 92 (shown in FIG. 13) that is interchangeable with the first extension beam 18. This would provide a ladder stand-off kit having component parts capable of being assembled into a ladder stand-off. Specifically, either one of the first and second extension beams 18 and 92 could be assembled with the first and second stand-off sections 74 and 76 to form a ladder stand-off. The second extension beam 92 has the same construction and cross-section dimensions as the first extension beam 18, but is longer in length. By way of example, the second extension beam 92 could be four feet long. When the user desires a greater span, the first and second stand-off sections 74 and 76 are removed from the first extension beam 18, and mounted on the second extension beam 92.

The ladder stand-off 10 is detachably secured to the ladder 12 through any suitable fastening means. One possible means for detachably securing the ladder stand-off 10 to the ladder 12 comprises a pair of U-bolts 66 that are threaded at both terminal ends, a pair of flat braces 68 having laterally spaced holes for receiving the legs of the U-bolts 66, and four threaded elements such as wing nuts 70. Each U-bolt 66 is placed over a corresponding support beam 78, 80 (or the extension beam 92) so that the bottom of the "U" abuts the first beam surface 24 and the two legs of the U-bolt 66 extend over the respective support beam 78, 80 (or the extension beam 92) and on opposite sides of the respective side rails 14. The flat braces 68 are mounted over the U-bolt legs so as to engage the back of the respective sides rails 14. Tightening the wing nuts 70 on the threaded legs of the U-bolts 66 thereby secures the supporting beams 78, 80 (or the extension beam 92) to the side rails 14. The ladder stand-off 10 is preferably, but not necessarily, attached to the ladder 12 with the beam 18 adjacent to the top most of the ladder rungs 16. In this case, the innermost leg of each U-bolt 66 can be positioned over the rung 16 (as shown in the Figures) so as to prevent the ladder stand-off 10 from slipping downward relative to the ladder 12. Other means for detachably securing the ladder stand-off 10 to the ladder 12 can also be used.

Figure 14:
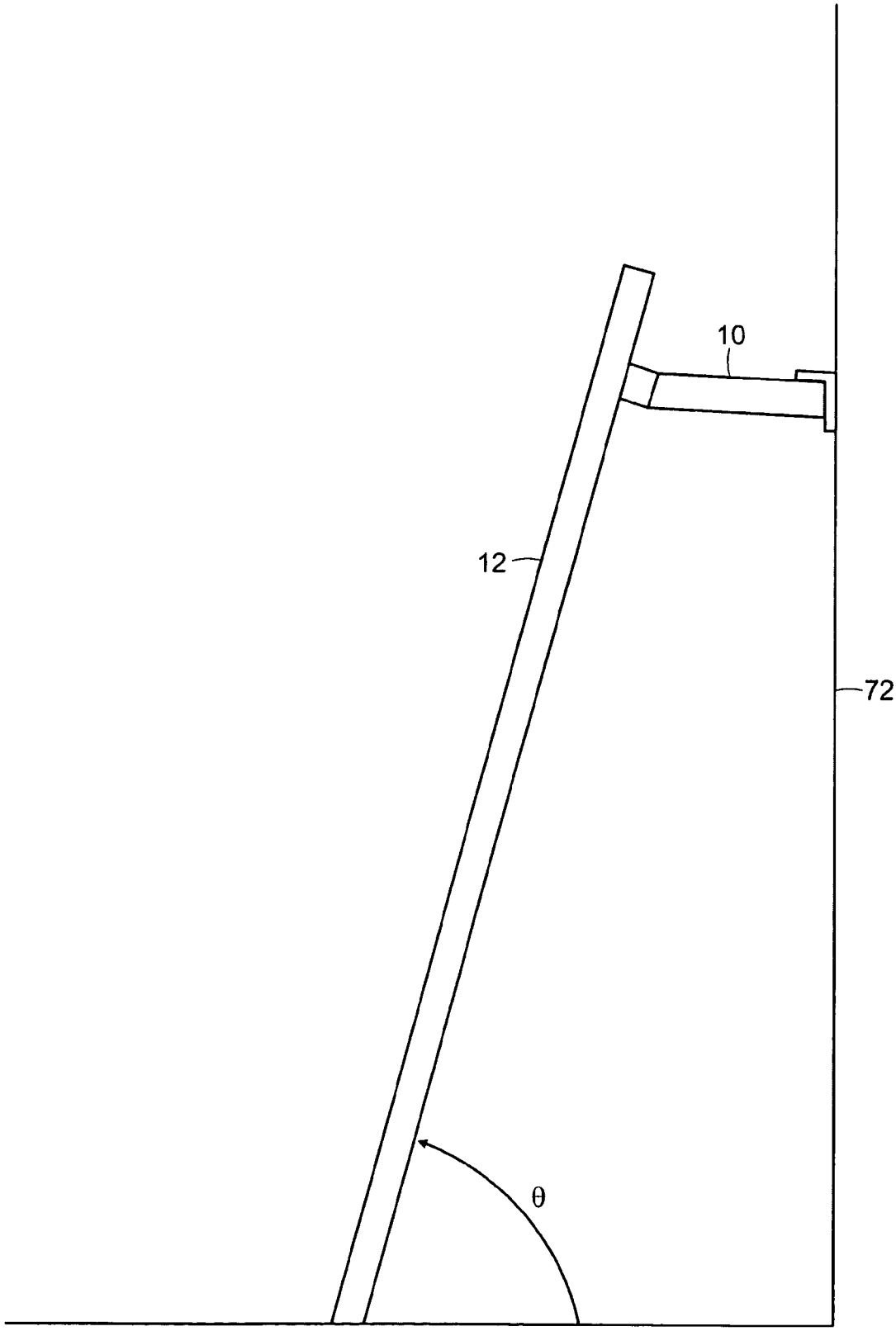
FIG. 14 shows a ladder having the ladder stand-off in use.

With the ladder stand-off 10 detachably secured thereto, the ladder 12 is placed on a horizontal surface, such as the ground or floor, and leaned against a vertical surface 72 (see FIG. 14) so that the resilient pads 40 of the contact elements 28 engage the vertical surface 72. The ladder 12 is oriented so that the resilient pads 40 are substantially flush against the vertical surface 72 and the arms 20 and 22 are parallel to the ground or floor or angled slightly downward as shown in FIG. 14. With this arrangement, the upward angle β of each arm 20, 22 relative to the beam 18 determines the angle of lean θ of the ladder 12 with respect to the ground or floor. For example, if the upward angle β is 12 degrees, then the ladder 12 would define an angle of 78 degrees with the ground or floor if the arms 20 and 22 are parallel to the ground or floor or an angle of about 75 degrees if the arms 20 and 22 are angled downward about three degrees.

Figure 8:
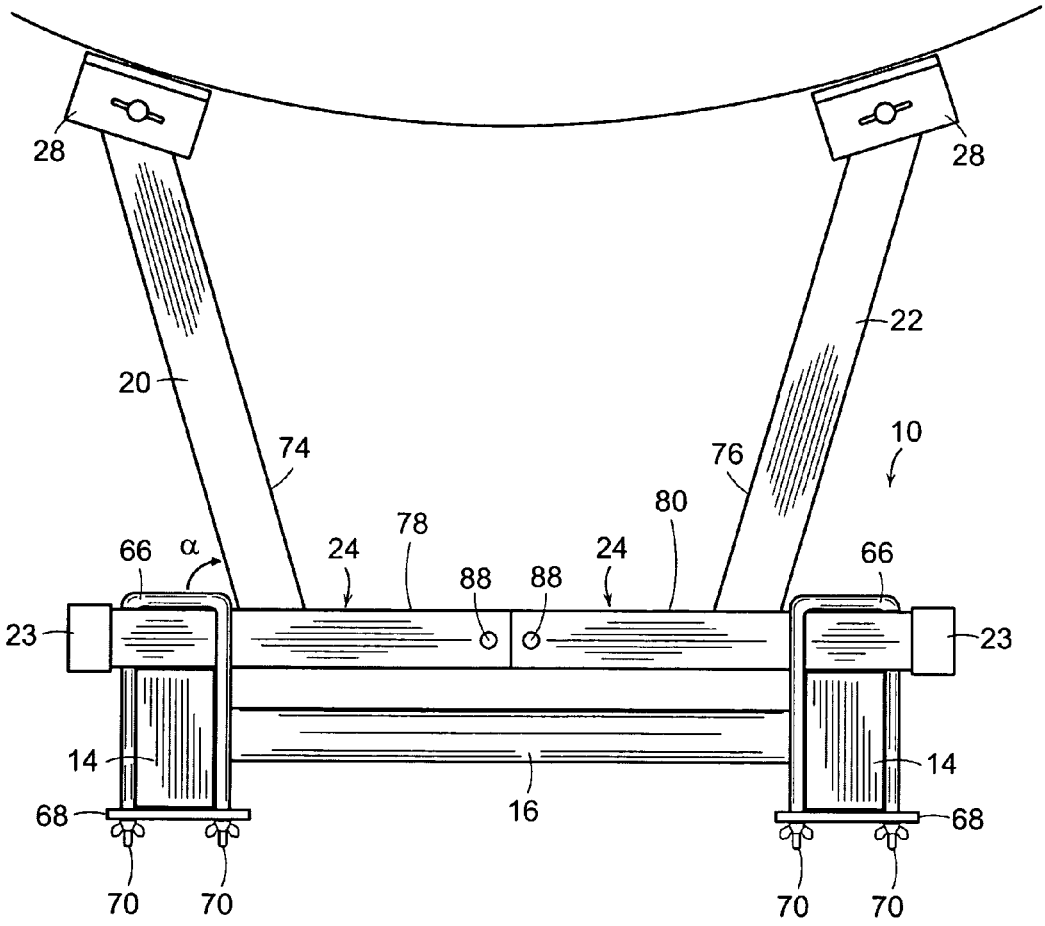
FIG. 8 is a top view of the ladder stand-off in use with a curved wall.

The pivoting nature of the contact elements 28 allows the ladder stand-off 10 to be used with a variety of vertical surfaces, including a flat wall (FIGS. 4 and 5), an outside corner (FIG. 6), an inside corner (FIG. 7), and a curved wall (FIG. 8). In addition to this versatility, the ladder stand-off 10 provides the advantage of being relatively compact. Thus, when using a ladder equipped with the ladder stand-off 10, it is easier to avoid hitting or becoming entangled with wires, tree limbs or other such obstacles around the work site. The narrow spacing of the arms 20 and 22 is helpful when working in tight spaces due to structural characteristics of the work site, such as a window set very close to a corner. Alternatively, when compactness is not an issue, the ladder stand-off 10 can be adjusted to provide a wide span. Another advantage of the ladder stand-off 10 is that because there are very few moving parts, there is little chance of parts becoming lost or damaged.

The ladder stand-off 10 can also be used in the manner of a ridge hook. That is, with the ladder stand-off 10 attached, the ladder 12 can be placed flat on a pitched roof with the ladder stand-off 10 situated over the peak of the roof. The arms 20 and 22 are oriented downward so that the contact elements 28 abut the roof on the other side of the peak. With this set-up, the ladder stand-off 10 will secure the ladder 12 on the roof, allowing a worker to walk on the ladder 12. When used in this manner, the innermost leg of each U-bolt 66 would preferably be positioned under the adjacent ladder rung 16 so as to prevent the ladder 12 from slipping downward relative to the ladder stand-off 10.

While specific embodiments of the present invention have been described, it will be apparent to those skilled in the art that various modifications thereto can be made without departing from the spirit and scope of the invention as defined in the appended claims.

What is claimed is:

1. A ladder stand-off comprising:

an extension beam;

a first stand-off section comprising a first support beam having two ends and a first arm fixedly connected at a first end thereof to said first support beam at a point located between said two ends of said first support beam, said first stand-off section being slidingly mounted on said extension beam;

a second stand-off section comprising a second support beam having two ends and a second arm fixedly connected at a first end thereof to said second support beam at a point located between said two ends of said second support beam, said second stand-off section being slidingly mounted on said extension beam, wherein said first and second arms are angularly divergent with respect to each other; and means for detachably securing said ladder stand-off to a ladder.

2. The ladder stand-off of claim 1 further comprising a contact element pivotally connected to a second end of each of said first and second arms.

3. The ladder stand-off of claim 2 wherein each contact element comprises an L-shaped member having first and second sections, said first section being pivotally connected to said second end.

4. The ladder stand-off of claim 2 wherein each contact element comprises a U-shaped member having two side legs joined by a central web, said side legs straddling said second end.

5. The ladder stand-off of claim 2 wherein said second end of each arm includes a pair of flanges and each contact element is positioned between a corresponding pair of said flanges.

6. The ladder stand-off of claim 1 further comprising means for fixing said first stand-off section relative to said extension beam and means for fixing said second stand-off section relative to said extension beam.

7. The ladder stand-off of claim 1 wherein said first and second arms define an angle therebetween that is less than 90 degrees.

8. The ladder stand-off of claim 1 wherein the length of said extension beam is substantially equal to the combined length of said first and second support beams.

9. The ladder stand-off of claim 8 wherein said first and second support beams are equal in length.

10. The ladder stand-off of claim 1 wherein the length of said extension beam is greater than the combined length of said first and second support beams.

11. The ladder stand-off of claim 1 wherein said first support beam defines a first hollow interior and a first portion of said extension beam is slidingly received in said first hollow interior, and said second support beam defines a second hollow interior and a second portion of said extension beam is slidingly received in said second hollow interior.

12. A ladder stand-off comprising:

an extension beam;

a first stand-off section comprising a first support beam and a first arm fixedly connected at a first end thereof to said first support beam, wherein said first support beam defines a first hollow interior and a first portion of said extension beam is slidingly received in said first hollow interior;

a second stand-off section comprising a second support beam and a second arm fixedly connected at a first end thereof to said second support beam, wherein said second support beam defines a second hollow interior and a second portion of said extension beam is slidingly received in said second hollow interior, and wherein said first and second arms extend in an outward direction so as to be angularly divergent with respect to each other; and means for detachably securing said ladder stand-off to a ladder.

13. The ladder stand-off of claim 12 further comprising a contact element pivotally connected to a second end of each of said first and second arms.

14. The ladder stand-off of claim 13 wherein each contact element comprises an L-shaped member having first and second sections, said first section being pivotally connected to said second end.

15. The ladder stand-off of claim 13 wherein each contact element comprises a U-shaped member having two side legs joined by a central web, said side legs straddling said second end.

16. The ladder stand-off of claim 13 wherein said second end of each arm includes a pair of flanges and each contact element is positioned between a corresponding pair of said flanges.

17. The ladder stand-off of claim 12 further comprising means for fixing said first stand-off section relative to said extension beam and means for fixing said second stand-off section relative to said extension beam.

18. The ladder stand-off of claim 12 wherein said first and second arms define an angle therebetween that is less than 90 degrees.

19. The ladder stand-off of claim 12 wherein the length of said extension beam is substantially equal to the combined length of said first and second support beams.

20. The ladder stand-off of claim 19 wherein said first and second support beams are equal in length.

21. The ladder stand-off of claim 12 wherein the length of said extension beam is greater than the combined length of said first and second support beams.

22. The ladder stand-off of claim 12 wherein said first support beam has two ends and said first arm is fixedly connected to said first support beam at a point located between said two ends of said first support beam, and said second support beam has two ends and said second arm is fixedly connected to said second support beam at a point located between said two ends of said second support beam.

23. A ladder stand-off kit comprising:

a first extension beam;

a second extension beam that is longer than said first extension beam;

a first stand-off section comprising a first support beam and a first arm fixedly connected at a first end thereof to said first support beam, said first stand-off section adapted to be slidingly mounted on either one of said first and second extension beams;

a second stand-off section comprising a second support beam and a second arm fixedly connected at a first end thereof to said second support beam, said second stand-off section adapted to be slidingly mounted on either one of said first and second extension beams;

wherein either one of said first and second extension beams, said first stand-off section, and said second stand-off section are capable of being assembled into a ladder stand-off and wherein the length of said first extension beam is substantially equal to the combined length of said first and second support beams; and means for detachably securing said ladder stand-off to a ladder.

24. The ladder stand-off kit of claim 23 further comprising a contact element pivotally connected to a second end of each of said first and second arms.

25. The ladder stand-off kit of claim 24 wherein each contact element comprises an L-shaped member having first and second sections, said first section being pivotally connected to said second end.

26. The ladder stand-off kit of claim 24 wherein each contact element comprises a U-shaped member having two side legs joined by a central web, said side legs straddling said second end.

27. The ladder stand-off kit of claim 24 wherein said second end of each arm includes a pair of flanges and each contact element is positioned between a corresponding pair of said flanges.

28. The ladder stand-off kit of claim 23 further comprising means for fixing said first stand-off section relative to said first extension beam and means for fixing said second stand-off section relative to said first extension beam.

29. The ladder stand-off kit of claim 23 further comprising means for fixing said first stand-off section relative to said second extension beam and means for fixing said second stand-off section relative to said second extension beam.

30. The ladder stand-off kit of claim 23 wherein said first and second support beams are equal in length.

31. The ladder stand-off kit of claim 23 wherein said first support beam defines a first hollow interior and said second support beam defines a second hollow interior, and wherein said first and second extension beams are sized to be slidingly receivable in both said first and second hollow interiors.

32. The ladder stand-off kit of claim 23 wherein said first support beam has two ends and said first arm is fixedly connected to said first support beam at a point located between said two ends of said first support beam, and said second support beam has two ends and said second arm is fixedly connected to said second support beam at a point located between said two ends of said second support beam.

* * * * *